US012514321B2

(12) United States Patent
Carlson

(10) Patent No.: US 12,514,321 B2
(45) Date of Patent: Jan. 6, 2026

(54) ADJUSTABLE HEAD ENGAGING APPARATUS WITH DISPLAY

(71) Applicant: Alan Carlson, Lago Vista, TX (US)

(72) Inventor: Alan Carlson, Lago Vista, TX (US)

( * ) Notice: Subject to any disclaimer, the term of this patent is extended or adjusted under 35 U.S.C. 154(b) by 0 days.

(21) Appl. No.: 18/601,934

(22) Filed: Mar. 11, 2024

(65) Prior Publication Data

US 2024/0315382 A1 Sep. 26, 2024

Related U.S. Application Data

(60) Provisional application No. 63/489,663, filed on Mar. 10, 2023.

(51) Int. Cl.
*A42B 3/14* (2006.01)
*A42B 7/00* (2006.01)

(52) U.S. Cl.
CPC ..... *A42B 3/145* (2013.01)

(58) Field of Classification Search
CPC ..... A42B 3/145
See application file for complete search history.

(56) References Cited

U.S. PATENT DOCUMENTS 3,455,528 A * 7/1969 Meyer ..... F16L 3/13 24/339
4,999,846 A * 3/1991 Ball ..... A42B 1/22 2/418
5,572,749 A * 11/1996 Ogden ..... G09B 9/307 2/418
5,671,037 A * 9/1997 Ogasawara ..... G02B 27/0176 345/905
5,696,521 A * 12/1997 Robinson ..... G02B 27/017 348/53
5,950,245 A * 9/1999 Binduga ..... A42B 3/145 24/68 B
6,186,145 B1 * 2/2001 Brown ..... A63F 13/52 600/300
7,007,306 B2 * 3/2006 Howard ..... A42B 3/14 2/9
8,296,868 B2 * 10/2012 Belanger ..... A42B 3/324 2/420
9,857,667 B2 * 1/2018 Kuroki ..... H04R 5/0335
9,949,522 B2 * 4/2018 Ketterer ..... A42B 3/324
10,405,612 B1 * 9/2019 Chan ..... A44B 11/12
11,602,274 B2 * 3/2023 Ross ..... G16H 40/67
12,201,395 B2 * 1/2025 Ross ..... A61B 5/6803
(Continued)

*Primary Examiner* — Robert H Muromoto, Jr.
(74) *Attorney, Agent, or Firm* — Alan Carlson

(57) ABSTRACT

An adjustable head engaging apparatus aka AHEA is disclosed. The AHEA can include a U shaped or radiused member having a nadir to engage a user's brow. A cross member can be affixed across the legs of the U shaped at a 90-degree angle or vertically such that the cross member's legs are attached at a right angle approximately midway down the length of the U shaped members arms. An adjusting member can be mounted to the cross member such that it will pivot towards the center of the AHEA thereby adjusting the inner dimensions of the AHEA. A user can use a control arm to move the adjusting member and a break/release member to hold the adjusting mechanism in place. When desired the user can activate a release mechanism where the adjusting member will automatically rotate away from the user to allow an easy exit from the AHEA.

20 Claims, 1 Drawing Sheet

(56) References Cited

U.S. PATENT DOCUMENTS

| | | | | |
|---|---|---|---|---|
| 2006/0070168 | A1* | 4/2006 | Nakabayashi | G02B 27/0176 2/171 |
| 2008/0276354 | A1* | 11/2008 | Stokes | A42B 3/145 2/418 |
| 2012/0174287 | A1* | 7/2012 | Lemke | A61F 9/06 2/209.11 |
| 2013/0205477 | A1* | 8/2013 | Pfanner | A42B 3/14 2/416 |
| 2015/0059065 | A1* | 3/2015 | Klotz | A42B 3/145 2/418 |
| 2017/0075198 | A1* | 3/2017 | Kuroki | G03B 17/561 |
| 2020/0315279 | A1* | 10/2020 | Maloney | A43C 11/1406 |
| 2021/0153593 | A1* | 5/2021 | Brooks | A42B 3/003 |

* cited by examiner

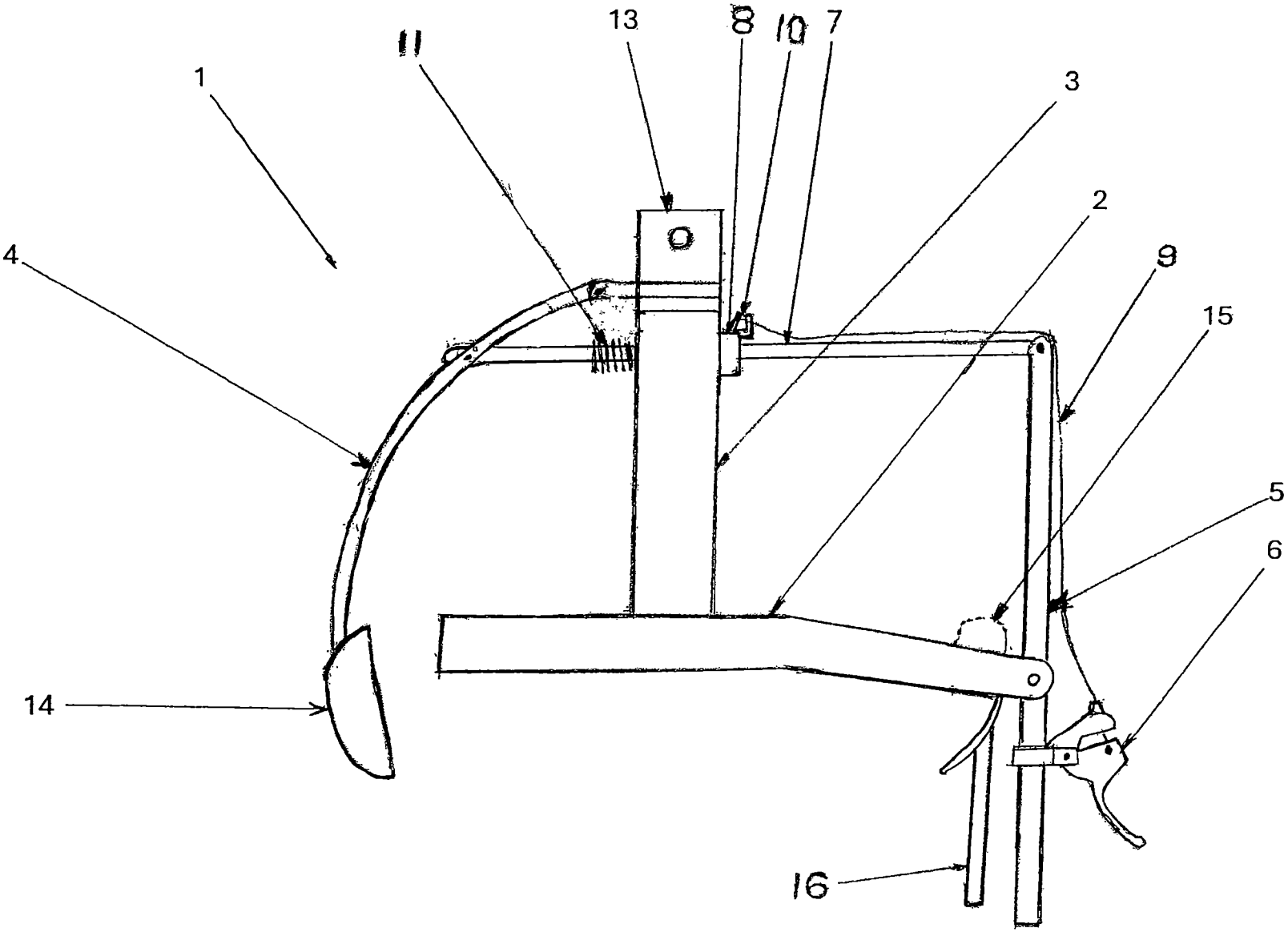
1
2
3
4
5
6
7
8
9
10
11
13
14
15
16

ADJUSTABLE HEAD ENGAGING APPARATUS WITH DISPLAY

FIELD OF INVENTION

The present disclosure is related to the field of exercise equipment and more specifically to headgear with a wide range of adjustment such that it can adequately accommodate a wide range of head shapes and sizes.

BACKGROUND

Many types of adjustable headgear exist for use in all types of sports. For example, removable headgear is worn in many combat sports such as wrestling to protect an athlete's ears from abrasion. Headgear are available in many sizes where certain adjustments can be made by lengthening and/or shortening various straps. For example, some headgear have one or more upper or over the head straps and at least one lower strap such as a chinstrap that allow for adjustment to accommodate a particular user's head size and shape. In a sport such as wrestling, typically each athlete will have their own headgear as it is not practical to often adjust such a headgear as it typically takes considerable time and effort to get a headgear perfectly adjusted to an athlete's preference. Another consideration is hygiene, as requiring an athlete to use another's dirty sweaty headgear is generally an unacceptable practice.

Regarding rehabilitation and/or fitness equipment, each piece of equipment has some form of user interface such as a bar, strap, handle or a pad which the user will either push, pull or move to effectuate a particular exercise. Most equipment also has specific adjustments that affect the user interface so the machine can effectively accommodate a wide range of the populace. Any such equipment requiring a headgear user interface presents significant design challenges for many reasons. One significant challenge is to provide adjustments such that the headgear can tightly engage a wide range of head shapes and sizes while remaining secure and comfortable during the exercise. For example, for a machine that caters to multidirectional movement of the head, it is highly desirable to have headgear that moves with and/or retains contacts points about the surface of a user's head. As a headgear that slips or does not move in concert with the user's head, it generally subjects the user to an undesirable experience in addition to not providing the desired exercise results. Further, if accurate, reliable and/or repeatable measurements are desired, slippage between the user's head and the headgear is undesirable and possibly intolerable.

Current headgear offerings are not user friendly in that it is not easy for a user to figure out how to adjust or properly adjust the headgear to achieve the best possible fit. In addition to being user friendly, prior art designs do not allow for an easy and immediate release from one's head. The lack of such a feature can be a significant drawback to a perspective user who has restraint anxiety.

Current offerings are not user friendly, in that they are not very comfortable, nor easy to clean or disinfect. Thus, prospective users who highly value hygiene will avoid contact with equipment with such a user interface. Available user interfaces for the head do not provide a good user experience as such a user interface has to appear sturdy, safe, clean and comfortable. Further, for such a user interface to provide the best user experience the headgear should minimize any obstruction of the users view.

Some prior art user interfaces adapted for the head can absorb moisture, dirt and/or grease and are not easy to fully clean and sanitize. Such user interfaces often do not appear clean such that a prospective user is not discouraged from using the exercise machine. All of the above-mentioned shortcomings in such equipment are substantial factors that affect the popularity, use and commercial success of a particular fitness machine. The abovementioned shortcomings are not surprising based on the difficulties of accommodating such a broad range of requirements.

BRIEF DESCRIPTION OF THE DRAWINGS

Aspects of the Disclosed Embodiments Will Become Apparent Upon Reading the Following Detailed Description and Upon Reference to the Accompanying Drawings in which, Like References May Indicate Similar Elements:

FIG. 1 depicts an adjustable head engaging apparatus (AHEA) that can be utilized in cooperation with a health-related device such as fitness, exercise or therapy equipment, a strength measurement, range of motion or other biometric measurement device.

SUMMARY OF THE INVENTION

Various arrangements for an adjustable head engaging apparatus (AHEA) are disclosed. The AHEA can be utilized in cooperation with other systems such as fitness equipment and biometric measurement equipment related to head and or neck movements. The AHEA can be used as a user interface for such systems. The structure of AHEA can include a U shaped (radiused) member having a nadir to engage the brow of a user. The arms of the U can then extend rearward proximate to a user's temple and past a user's ears. A arched or radiused cross member can be also be configured as an upside down horseshoe with its legs attached to each arm (about half way down the arms) at a right angle to U shaped member. Thus, the arched member can form an arch up and over the top of the head of a user near the location of where a user's ears are or will be located as arched member connects both sides/arms of the U-shaped member that engages the user's brow.

In some embodiments, an arched adjusting member can be pivotably mounted proximate to the apex of the cross member (above and near the center of the user's head) such that the adjustment member can pivot towards the back of the user's head changing the dimension of the inner surface area of the AHEA. Accordingly, a user can operate an adjustment lever located at the front of the AHEA proximate to where the user's brow engages the AHEA. When a user pulls the bottom of the adjustment lever towards them, a slidable linkage with a brake coupled to the adjustment member (user interface) moves the adjusting member towards the rear of the user's head.

After a user has the adjusting member moved to a location where the users head is properly secured in the AHEA, the user can provide a control input to lock the adjusting member in place via the brake or a clutch. In some embodiments the clutch only allows the adjusting member to move towards the user's head and then automatically locks into position. When the user desires to be freed from the AHEA, the user can activate a release trigger and the adjusting member will be released from its adjusted position and will retract away from the user's head making it easy for the user to exit the AHEA.

In some embodiments the portion of the AHEA that engages the users forehead and occipital area can have contours that match the corresponding contour of the user. Further the inner side surfaces of the AHEA can be angled for example in a conical shape to reduce slippage on a user's head to improve the user experience.

DETAILED DESCRIPTION OF EMBODIMENTS

The following is a detailed description of embodiments of the disclosure depicted in the accompanying drawings. The embodiments are in such detail as to clearly communicate the disclosure. However, the amount of detail offered is not intended to limit the anticipated variations of embodiments. The description that follows is for purposes of explanation and not limitation, specific details are set forth such as particular structures, architectures, interfaces, techniques, etc. to provide a thorough understanding of the various aspects of the invention. However, it will be apparent to those skilled in the art having the benefit of the present disclosure that the various aspects of the disclosure may be practiced in versions that depart from these specific details. In certain instances, descriptions of known apparatuses, systems and methods are omitted so as not to obscure the explanation, teaching and description of the claimed embodiment with unnecessary detail. The teachings herein are intended to cover all modifications, equivalents, and alternatives falling within the spirit and scope of the present disclosure as defined by the appended claims.

The teachings herein disclose many new and novel features relating to an adjustable head engaging apparatus (AHEA) 1 for use with applicable biometric measurement, fitness, virtual reality and gaming equipment. In some embodiments, AHEA 1 can act as a user interface for fitness equipment that is adapted to exercise one's neck, body core and/or any muscles used to control one's head in relation to any other part of their body. More particularly AHEA 1 can be used in fitness equipment that provide full range hemispherical range of motion to the user. In operation, a user can enter the machine and insert their head into an opening (at the bottom) of AHEA 1, then pull on as single adjustment lever to secure their head in AHEA 1 prior to exercise measurement or immersion.

Referring to the Embodiment Shown in FIG. 1, AHEA 1 can be Comprised Generally of the Elements Listed Below:

1 Adjustable head engaging apparatus (AHEA)
2 U frame
3 Cross member
4 Adjusting member
5 Adjustment lever
6 Release
7 Slidable link
8 Clutch
9 Release link
10 Release trigger
11 Retracting spring
13 Attachment location
14 Occipital engaging structure
15 Brow engaging structure
16 Display AHEA 1 has many features for effectively and comfortably retaining a user's head during user head movements against resistance. Some elements and element attachment locations in FIG. 1 are not to scale and possibly not in an optimum location. However, AHEA 1 can be manufactured with dimensions to provide a good fit and a positive user experience. In some embodiments AHEA 1 can have dimensions and contoured surfaces such that a high percentage of the population with a wide range of head sizes and shapes can be effectively accommodated by AHEA 1. The disclosed arrangements can sufficiently engage important locations about the human head such as the brow and occipital regions. When properly adjusted AHEA 1 will apply a desirable pressure to locations about a user's head such that points of contact can be maintained on the user's head as the user applies forces to the user interface in any direction as a user moves their head about a full hemispherical range of motion.

Alternatively described, AHEA 1 can sufficiently engage areas of the head, such that during exercise, AHEA 1 will not slip in relation to a user's head and will move in substantial unison with the user's head. FIG. 1 depicts a semi rigid frame of some AHEA1 embodiments. However, a completed AHEA 1 will typically have some form of padding with a durable coating placed about the frame to engage the user. Thus, FIG. 1 shows a "naked" frame embodiment void of padding and any covering. The addition of padding will not materially change the features described below as provided by the underlying semi rigid frame. Thus, the shapes, angles, configurations, and structure of the AHEA frame define features and functions that assist and work collectively with the padding and coating to accomplish the desired features disclosed for securing a user's head.

AHEA 1 can include a U frame 2 with a U-shaped cross member 3 attached perpendicular to the U frame 2 from one leg of the U frame 2 to the other leg of the U frame. The forward inside surface of U frame 2 or nadir of U frame 2 can be configured to comfortably engage a user's forehead. Thus, U frame 2 can have a radiused surface at it's nadir (to the right side of FIG. 1) that is compatible with a typical/average radius of a human forehead that will be using the AHEAD 1.(often a 10 inch radius). During adjustment, the user by operating adjustment lever 5 can move adjusting member 4 towards the nadir of U frame 2 (forward or to the right of FIG. 1) to secure their head inside AHEA 1.

Adjustment lever 5 can be connected to adjusting member 4 via slidable link 7. After a user inserts their head in the underside of AHEA 1, they can pull adjustment lever 5 towards their head until both their brow and occipital bone are in contact with their corresponding surfaces. Thus, when adjustment lever 5 is pulled towards a user's forehead, adjustment lever 5 can pivot about a point proximate to the forehead surface 13, where correspondingly the top portion of adjustment lever 5 will travel in the forward direction, pulling slidable link 7 forward which in turn will pull on adjusting member 4 below its pivot point. Pulling on adjusting member 4 will correspondingly move occipital engaging surface 12 forward towards the back and underside of the user's head. Accordingly, when user pulls adjust lever 5 towards them, adjusting member 4 will rotate with its lower end moving towards and under the occipital bone at the rear of the user's head.

Slidable link 7 can pass one direction (forward) through clutch 8. Clutch 8 can include a liner bearing and a ratchet, Chinese finger trap, or clamping type mechanism which allows slidable link 7 to travel freely in one direction (forward) but prevent slidable link 7 from moving in the opposite direction (i.e. prevents adjusting member 4 from moving away from the rear of a user's head). Clutch 8 can be embodied as a ratcheting system where a spring loaded dog engages teeth or serrations on slidable link 7 to prevent movement in one direction. Thus, when adjusting member 4 confines the user's head against brow engaging structure 15 with the desired pressure responsive to the force a user applies to adjustment lever 5, clutch 8 will hold the pressure on the user's head until clutch 8 is deactivated by the user via release 6 which activates release link 9 which can move a release trigger 10 in clutch 8.

As stated above clutch 8 can take many mechanical forms. In one embodiment clutch 8 can function similar to the one-way mechanism utilized by a bar clamp, a slip clutch or a "Bessey" style clutch having one or more clutch plates or jam mechanisms. Accordingly, after the user applies a force on adjust lever 5 to move the occipital engaging surface 12 forward it will place the brow of the user's head in contact with brow engaging structure 15. As the user applies more force on the adjustment lever 5 the user's head be secured between these surfaces and when the user ceases exerting an adjustment force on pull lever 5, clutch 8 will engage and retain the relative position of the occipital engaging surface to the brow engaging structure 15.

After adjustment, the user can then exercise (or conduct a test) and when exercise is completed the user can activate release 6 which will activate the release trigger 10 of clutch 8 via release link 9. Such an activation by the user will release the clutches grip on slidable link 7, allowing spring 11 to act upon and move slidable link 7 rearward many inches, in unison with adjusting member 4. As a result, adjusting member 4 will pivot backwards retracting occipital engaging structure 14 from and away from the rear of the user's head making it easy for a user to exit AHEA 1.

Release 6 can be configured similar to a bicycle hand brake lever and release link 9 can be embodied as a push pull cable which is also compatible with a bicycle hand brake. Clutch 8 can hold slidable link 7 and adjusting member 4 in place during user movements by preventing adjusting member 4 from moving back or away from the user's head, thereby adequately securing a user's head during an exercise routine of measurement operation.

Adjusting member 4 can be pivotably attached to an upper portion of cross member 3. When user's head is inside U frame 2, and the user pulls on adjustment lever 5, adjusting member 4 will pivot forward (towards front segment of U frame 2) and slightly upward to secure the user's head in AHEA 1. Adjusting member 4 can have a pivot on one end and an occipital engaging structure 14 at a second end. Occipital engaging structure 14 can be embodied or contoured similar to a "bowl" shaped surface such that its concave surface substantially conforms to the back of a human head generally a partial spherical surface the size of a softball. The pivot point of adjusting member 4 can be configured at a location above where the head will be positioned near and attach location 13 where AHEA 1 can be attached to a resistance system or other type of system for biometric measurement, exercise or entertainment.

Adjusting member 4 can be arched shaped defined by a radius of greater than 10 inches and pivot or rotate to such an angle where padding (not shown) on occipital engaging structure 14 can engage the hemispherical shape of a user's occipital bone. Thus, the structure that supports the padding on occipital engaging structure 12 can be shaped as a modified hemispherical such that it can effectively engage and retain the occipital bone at the rear of the skull.

U frame 2 can generally be configured as a hybrid "U-V" shape with a relatively straight eight-inch frontal segment (for example 4 inches each side of the center line of the frame 2) which can engage the forehead of a user. Although being relatively straight would be acceptable, the frontal segment can also be slightly curved as defined by a relatively large radius (i.e. 14 inches). At the edges of the frontal segment portion of frame 2, frame 2 can provide an increased curvature (decreasing radius curve) approximately four and a half inches from frame centerline. In some embodiments, U frame 2 can be configured wide enough to fit generally the contour or shape of the frontal bone of 90% of the human populace. The rearward portion of U frame 2 (opposite the frontal segment) can consist of two "legs" that maintain a "V" shaped angle between them.

A brow engaging structure 15 can be secured to the frontal segment of U frame 2. Brow engaging structure 15 can be embodied in a half conical shape or decreasing radiused plate that is cupped and/or tilted inward towards the center AHEA 1. Brow engaging structure 15 can support a padding and forces applied by a user below/under U frame 2 by engaging the lower portion of a user's brow or just an area just above a user's eyes. Such an inward radiused conical surface can effectively engage the user's head as the user applied vertical forces at the edge of a user's range of motion. Accordingly, as the user rotates their head forward (flexion), the conical shaped plate provides a surface to securely engage the user's head on three sides of the front of the head (brow) along a plane aligned with the bone forming the top of a user's eye sockets.

Padding on the inside surface of U frame 2 (including surface 15) will make the inside dimensions of AEHA 1 inches smaller/narrower than the dimensions noted above. The thickness of the padding on the inside surfaces of AHEA 1 can be configured such that the padding will act as a buffer to accommodate heads of different shapes and sizes from youth sizes to professional football player head sizes.

Cross member 3 can also be "U" shaped and rigidly attached at each end to a leg of U frame 2 such that cross member 3 will traverse over a location where a user will be placing their head and attach to each leg of U frame 2. Cross member 3 can be located near the center of U frame 2 and can be mounted substantially perpendicular to U frame 2. In some embodiments, both cross member 3 and frame 2 can have attach points (such as 13 and one near a user's ear location directly below point 13) at various locations to allow for AHEA 1 to efficiently attach to fitness or measurement equipment as a user moves their head about their normal hemispherical motion.

Adjusting member 4 can have a pivot point on one end (attached to the top of cross member 3) and can have a radiused concaved surface, cup shaped or occipital engaging surface 14 on its other end for engaging the occipital bone of the user. Adjusting member 4 can be configured such that it can effectively apply an upward force on the underside of a user's occipital bone when adjusted sufficiently forward. The cup or pocket shaped pad can also resist the movement of a user's head from side to side as it can create a hemispherical contact surface about the user's occipital bone. Such a surface can effectively engage and retain the rear of a user's head to create a good user experience for exercise and accurate measurements values as the case may be.

Alternately described, adjustment member 4 can be pivotably attached to the top portion of cross member 3 at one end proximate to where a slidable link 7 is attached that can pull adjusting member 4 towards the user's head. The other end of adjusting member 4 can engage the rear of a user's head via a structure formed to surround the user's occipital bone (i.e occipital engaging structure 14). Thus, occipital engaging structure 14 can have a three dimensional contoured spherical surface configured to "cap" the occipital bone, including the overhanging surface of the rear of the skull formed by the occipital bone.

In some embodiments brow engaging structure 15 can be embodied as a half bowl shape, generally defined by a decreasing radius surface that protrudes below U frame 2.

The contour of brow engaging structure 15 can accommodate the narrowing shape of a head below the brow area as defined by the temporalis muscles when a user's head has been rotated substantially forward. It can be appreciated that as the user's head begins rotating forward, the angle of a user's brow transitions from vertical to horizontal such that the bottom portion of one's brow places more pressure on the lower portion of brow engaging structure 15. This is particularly true as AHEA 1 rotates past 45 degrees.

Alternately explained, as a user rotates their head forward (flexion) pushing on brow engaging structure 15 the force of the forehead/brow on AHEA 1 becomes predominantly a downward/vertical force. Such a phenomena occurs in every direction of rotation from a vertical start or normal position of a user's head. Accordingly, the padding installed on the inside surface of AHEA 1 can provide a conical or a surface that has a greater diameter above U frame 3 than below the U frame 3.

A conical inner surface provides synergistic benefits as when the head is pivoted say 30 degrees from vertical, the force component applied by the head starts to have an even greater downward/vertical force on the AHEA 1. A conical shaped inner surface can better secure a user's head within AHEA 1 during full rotation. A conical shaped inner surface can improve the functionality of AHEA as it has been discovered that such a conical surface will better maintain contact with the applicable portion one's head particularly as the downward force component applied by the user increases.

In some embodiments it is desirable for AHEA 1 to be as lightweight and as strong and durable as possible. Some flexing and deformation of AHEA 1 is acceptable in many embodiments as long as the required structural integrity is not compromised. U frame 2, cross member 3 adjusting member 4, adjustment lever 5 and other components disclosed can be made of strong lightweight material such as aluminum, titanium, fiberglass, reinforced plastic, and/or carbon fiber.

The rigid components of AHEA 1 mentioned above can be encircled and/or covered using a pourable moldable urethane foam having the desired thickness and density and/or compressibility at each location of the inner surface of AHEA 1. Such compressive properties of padding can be defined in pounds per squire inch required to deform the foam to a certain depth based upon a predefined thickness. Research has shown that a flexfoam-IT product (high density expanding foam) from Smooth-on Inc. provides acceptable compressive properties and rigidity for the inner surface of AHEA 1.

The size of the mold and frame structure provided for attachment (flow throughs etc.) can greatly affect the density and durability of the padding. After the liquid foam is molded and cured on the applicable surfaces of AHEA 1, the foam can be covered with a reinforcing elastic fabric and then a silicon rubber layer can be added to protect the foam (no shown). The silicon rubber layer can provide a robust waterproof surface that has little effect on the compressive properties of the foam padding. The silicon rubbed surface is flexible and can also provide some desired friction on a user's head make AHEA 1 surfaces easy to clean and sanitize. The silicon rubber can provide a very flexible surface that retains the foam padding in place while being resistant to tearing.

Prior to applying the foam and then the silicon, portions of the AHEA 1 can be wrapped with a stretch reinforcing mesh fabric or fibers. Such reinforcement provides significant resistance to shear stresses, tearing and other wear and significantly improve the durability and lifetime of the surfaces of AHEA 1. In some embodiments the interior padded contact surface of AHEA 1 can have a varying density of padding with softer (lower density) foam at the top circumference and stiffer foam around the bottom circumference. Such a configuration provides a conical feel to the user as when the user pushes on the inner surface, the softer foam contacting the upper head region will compress more than the stiffer foam proximate to the user's ears (lower on the head) thereby minimizing slippage of the AHEA 1 on a user's head during exercise. Such results are similar to the conical shaped padding disclosed above.

In some embodiments it is desirable that U frame 3 be positioned just above the user's eyes such that the users view is not obstructed. In some embodiments an upper strap or pad structure (not shown) can be secured to cross member 3 to assist in the placement of and to assist in securing of the top of the user's head. One or more upper straps can limit the distance in which a head can be inserted into AHEA 1 and when attached to a chinstrap can allow AHEA 1 to better secure the user's head. In some embodiments a chinstrap can be installed (not shown) similar to a chinstrap utilized by football helmets and wrestling headgear.

Chinstrap can be connected to the upper strap via hook and loop fasteners such that the dept in which a user can insert their head and movement of a user's chin in relationship to AHEA 1 can be effectively controlled. Tightening a chinstrap that is attached to one or more upper (over the head) straps can be configured such that such a process pulls down and secures or tightens the over the head straps further restraining the crown of the head and chin thereby further reducing the likelihood of slippage of AHEA 1 in relationship to a user's head.

Some embodiments can include a display 16 placed directly in front of a user's eyes. Display 16 can be configured and operate similar to how virtual reality goggles operate to provide a user with an immersive 360-degree Field of view experience. Display 16 and its corresponding content delivery system can be configured substantially similar to a virtual reality or augmented reality headset systems available from Apple, Google, Samsung and others. Such a configuration will allow an athlete to be "placed" in real game/match situations while engaged by the headgear to measure the athlete's performance under certain conditions.

In one example, a soccer athlete can be placed in a specific game situation/environment/position such as in front of a goal where a soccer ball is incoming from a corner kick where the user is requested to head the ball into the goal. In some embodiments, a system coupled to the AHEA 1 could simulate real world forces such as the impact of the ball on the user's head and biometric measurements can be acquired regarding the athlete's strength, muscle control, best positioning, muscle activation, reaction time and coordination allowing evaluation of user performance.

In another example, an athlete can be placed/immersed in a particular position in a football game simulating impending collisions and impacts to the user's head region while monitoring an athlete's general reaction, reaction time, muscle activation response and strength, anticipatory responses and other data which is critical to understating injury prevention. Using AHEA1 to acquire biometric data such as user response data related to neck injuries will prove invaluable to understand and prevent concussions and cervical spine injuries. For example, understanding what neck muscles a user activates, the intensity of activation, muscle reaction time etc. can identify athletes that are at high risk of concussions and cervical spine injury. different data profile.

Data that can be acquired can also include range of motion and fatigue, issues cause by fatigue, dynamic strength, elastic strength from anticipatory impact and other important parameters can be monitored/measured via CAT scan, EEG, EKG, ECG, MRI, Sonogram, ultrasound, force gages, acceleration gages, video analysis and other medical/biometric type monitoring systems. All such data can then be coordinated in time to get a better picture of the neck's complex movements and can be used to identify at risk athletes. Regarding screening the parameters measured, at risk metrics can be based on the biometric data acquired further in view of age, sex and the sport in which there will be participation.

In other embodiments, AHEA 1 can be attached to a system that provides active motion and feedback to the head gear (and the users head). For example, AHEA could be utilized by Air Force personnel to subject a candidate for flight school to the G-force conditions to which the pilot would be or would be subjected to as part of training and everyday operations.

Thus, AHEA 1 can be utilized to simulate any desired environment to determine an individual's performance in such an environment via the use of a virtual/augmented reality system. During such simulations valuable data can be acquired which can be utilized to develop tolerance and injury prevention protocols. Thus, an athlete can be immersed in a sporting event or work environment and subjected to various events where important biometric data can be acquired such that propensity for injury and improving performance can be evaluated. Thus, data acquirable via use of AHEA 1 can be used to identify at risk athletes and then to help the athlete mitigate the likelihood of injury by for example being used in exercise equipment to strengthen the athlete's neck. The acquisition of biometric data obtained using AHEA 1 will prove invaluable in understanding and establishing a solid foundation for brain and neck injuries knowledge allowing for the development of injury prevention/concussion prevention protocols.

It will be apparent to those skilled in the art having the benefit of this disclosure, that the disclosure contemplates methods, systems, and media that can provide the above-mentioned features. It is understood that the form of the embodiments shown and described in the detailed description and the drawings are to be taken merely as possible ways to build and utilize the disclosed teachings. It is intended that the following claims be interpreted broadly to embrace all the variations of the example embodiments disclosed.

What is claimed is:

1. A head engaging apparatus comprising:

a radiused member substantially U-shaped having a first arm and a second arm with a brow engagement interface in a nadir region therebetween and an opening opposite the brow engaging interface;

a cross member configured as a substantially rigid U-shape and coupled to the first arm and the second arm of the radiused member;

an adjustment member, substantially rigid and having an occipital engagement surface on a first end and pivotably coupled to the cross member such that when the adjustment member pivots, the occipital engagement surface moves in relation to the brow engagement interface to define an inner circumference of the head engaging member;

a control member coupled to the adjustment member to control a position of the adjustment member wherein the control member is operable to control a distance between the occipital engagement surface and the brow engaging interface;

a clutch coupled to the adjustment member and operable to control the adjustment member in a selected position; and a release coupled to the clutch, wherein activating the release deactivates the clutch's control of the adjustment member.

2. The head engaging apparatus as in claim 1 wherein the clutch further comprises a one-way releasable clutch.

3. The head engaging apparatus as in claim 1, further comprising a rigid slidable link coupled to the clutch and coupled to the release wherein the clutch engages the slidable link.

4. The head engaging apparatus as in claim 1 wherein the occipital engaging structure further comprises a concave surface configured to of rotate towards an occipital region of a user's head.

5. The head engaging apparatus as in claim 1 wherein the cross member extends upwards from the radiused member, and wherein the brow engaging interface further comprises a concave surface extending downward from the nadir region of the radiused member at an inward angle to engage a lower brow region of a user.

6. The head engaging apparatus as in claim 1 further comprising a display coupled to the radiused member to display content to a user.

7. The head engaging apparatus as in claim 6 further comprising a simulation-feedback system coupled the display to acquire data on a user's reactions to the displayed content.

8. The head engaging apparatus as in claim 1, further comprising padding coupled to the radiused member, the brow engaging interface and the occipital engaging structure, wherein the padding further comprises a urethane foam.

9. The head engaging apparatus as in claim 7 further comprising a layer of silicon-based rubber covering the urethane foam, a non-absorbing contact surface.

10. The head engaging apparatus as in claim 1 wherein the adjustment member further comprises a curvature between the pivot point and the occipital engaging structure such that when the occipital engaging structure moves towards the brow engaging interface it travels at least partially in an upward trajectory towards a center of the head engaging member.

11. The head engaging apparatus as in claim 1, further comprising an upper interior padded surface closest to the cross member and a lower interior padded surface furthest from the cross member wherein the padding on lower interior surface has a higher compression strength than the padding on the upper interior padded surface.

12. The head engaging apparatus as in claim 1, wherein the radiused member further comprises a radiused member manufactured from carbon fiber.

13. The head engaging apparatus as in claim 1, further comprising an elastic member coupled to the adjustment member wherein when the clutch is released the elastic member moves the adjustment member to an unbiased position to facilitate a user's egress.

14. The head engaging apparatus as in claim 1, wherein the control lever mount forward of the nadir in view of a user of the head engaging apparatus.

15. The head engaging apparatus as in claim 1, wherein the release is mounted on the control member.

16. The head engaging apparatus as in claim 1, wherein the release is mounted forward of the nadir in view of a user of the head engaging apparatus.

17. The head engaging apparatus as in claim 7, wherein the stimulation-feedback system is configured to acquire a user's reaction time to displayed contact.

18. The head engaging apparatus as in claim 1, wherein an inner surface of the radiused member further comprises a beveled surface with a greater diameter closer to the cross member than a diameter farther from the cross member.

19. The head engaging apparatus as in claim 1, wherein the release is located forward of the brow engaging interface.

20. The head engaging apparatus as in claim 1, further comprising a resistance system that holds the head engaging apparatus in an unbiased position and provides resistance to a user's movement of the head engaging member as the head engaging member is moved about a hemispherical range of motion.

* * * * *